United States Patent [19]

Gage

[11] Patent Number: 4,934,866

[45] Date of Patent: Jun. 19, 1990

[54] SECONDARY FLUID CONTAINMENT METHOD AND APPARATUS

[75] Inventor: Donald G. Gage, Cedar Hill, Tex.

[73] Assignee: Secondary Containment, Inc., Dallas, Tex.

[21] Appl. No.: 321,754

[22] Filed: Mar. 10, 1989

[51] Int. Cl.[5] ..... B65G 5/00

[52] U.S. Cl. ..... 405/54; 405/55; 405/270; 220/417; 264/35; 264/309

[58] Field of Search ..... 405/53–55, 405/270, ; 52/169.9, 139, 140; 220/417, 5 A, ; 264/35, 309

[56] References Cited

U.S. PATENT DOCUMENTS

| | | | |
|---|---|---|---|
| 3,252,155 | 5/1966 | Surtees et al. | 405/54 |
| 3,415,022 | 12/1968 | Schaefer et al. | 52/169.7 |
| 3,930,590 | 1/1976 | Ebbrell | 220/9 LG |
| 4,068,777 | 1/1978 | Humphrey et al. | 220/1 B |
| 4,110,947 | 9/1978 | Murray et al. | 52/249 |
| 4,125,983 | 11/1978 | Jarrell | 405/270 X |
| 4,288,952 | 9/1981 | Work | 52/140 X |
| 4,344,543 | 8/1982 | Hoffman | 220/5 A X |
| 4,375,860 | 3/1983 | Greaves, Jr. | 220/1 B |
| 4,682,911 | 7/1987 | Moreland | 405/53 |
| 4,826,644 | 5/1989 | Lindquist | 264/35 X |

*Primary Examiner*—Dennis L. Taylor
*Assistant Examiner*—Arlen L. Olsen
*Attorney, Agent, or Firm*—Hubbard, Thurman, Turner, Tucker & Harris

[57] ABSTRACT

An underground storage tank installation apparatus and method for installing the same. The apparatus includes a fiberglass vault into which one or more underground storage tanks are secured and buried in a suitable excavation. Structural support members are formed within the walls of the fiberglass vault to provide adequate strength for the walls of the fiberglass vault so that the chances of cave-ins are minimized. Internal and external observation wells are provided, with automatic leak detectors, so that any leakage either inside or outside the fiberglass vault is automatically detectable. The preferred method for installing the fiberglass vault is to excavate a pit of predetermined dimensions and pour a concrete base in the bottom thereof. The sides of the pit are lined with sheetrock panels and a liquified fiberglass mixture is sprayed on to the panels and concrete slab, with vertical support members being secured to the sheetrock panels between subsequent layers of the fiberglass coating. One or more underground storage tanks are secured to the floor of the fiberglass vault and connected to conventional piping. Internal observation wells with automatic leak detectors are placed within the fiberglass vaults before the vault is backfilled to ground level and sealed with a solid slab. The complete installation of the underground storage facility is accomplished without the necessity of personnel standing or walking in an unsupported excavation.

33 Claims, 2 Drawing Sheets

SECONDARY FLUID CONTAINMENT METHOD AND APPARATUS

FIELD OF THE INVENTION

The present invention relates generally to underground facilities for the storage of liquids, and more particularly to a secondary containment apparatus for preventing contamination of the surrounding ground caused by leakage, and to the method for constructing said apparatus.

BACKGROUND OF THE INVENTION

In the prior art, tanks used as reservoirs for storing fluids, such as gasoline, are generally installed underground. A typical example of such installation is the underground gasoline storage tank utilized at practically every automobile service station throughout the United States. Historically, such storage facilities have consisted essentially of large steel tanks buried beneath the concrete or asphalt surface of the service station. Steel tanks, however, tend to corrode after being buried for several years and must be repaired or replaced to avoid leakage and the resulting contamination of the surrounding ground and water supplies. During recent years, national attention has frequently been focused on the severe health hazards presented by underground fluid storage facilities which have failed to prevent their toxic contents from seeping into the surrounding earth and water. As a result, service station operators and others have sought economical ways of reducing the possibility of underground leakage and improving the ability to detect such leaks should they occur.

One conventional solution to the problems discussed above is the use of insulated or double walled tanks in conjunction with leak monitoring devices, such as the installation disclosed in U.S. Letters Pat. No. 4,110,947 issued on Sept. 5, 1978. Installations of this sort do an adequate job of detecting and containing leaks, but double walled tanks are very expensive and present some unusual installation problems. If the inner and outer walls of the double walled tank are both constructed of steel, for instance, the tank will be extremely heavy and difficult to maneuver into position. If, on the other hand, either or both walls are made of fiberglass, the tank will be comparatively light but it will also be delicate, so that the slightest bump during installation could cause undetectable damage to one or both walls. Additionally, regardless of whether they are steel or fiberglass, double walled tanks are larger than conventional tanks of the same capacity.

Another common solution to the leakage problems experienced with conventional tanks is the use of solid concrete vaults to encase the tanks. Vaults of this nature are typically rectangular in shape, with a floor and four walls constructed of reinforced concrete. The construction of such concrete vaults is laborious and time consuming, since forms must be placed along the walls and floor of the excavation and the concrete carefully poured into the forms and allowed to dry. Typically, freshly poured concrete vaults must cure for three or four days before the floor and walls are sturdy enough to allow the installation of the storage tank therein. In addition to the inordinate amount of time involved in building them, concrete vaults also experience frequent cracking problems, which would allow any leakage from the tank to enter the surrounding earth. In practice, concrete vaults have proven to be time consuming and generally unreliable devices for containing underground storage tanks.

Still another popular solution to underground leakage problems is the use of a leak-proof liner to surround the tank within the excavation. Typically, such liners consist of large plastic or vinyl sheets placed within the excavation prior to installing the tank. The most significant drawback with this technique is that the tank cannot be properly anchored without piercing the liner. The usual method of securing storage tanks in place includes the use of anchors either embedded in a concrete floor or retained by the gravel backfill. It is not feasible to employ such anchors with leak-proof liners, since an anchor protruding through the bottom of the liner would clearly destroy the liner's leak-proof characteristics. Additionally, the use of leak-proof liners requires that the walls of the excavation be shored or severely sloped to avoid cave-ins during installation; leak-proof liners are generally very flexible and do not provide any support for the earthen walls of the excavation. In consideration of the many problems associated with conventional underground storage tank installation methods, the present invention was developed to eliminate these problems.

SUMMARY OF THE PRESENT INVENTION

It is an object of the present invention to alleviate the disadvantages and deficiencies of the prior art by providing a relatively inexpensive underground storage tank system which adequately contains any leakage from the tank, thus preventing the contamination of the surrounding ground. It is also an object of this invention to provide leakage detectors so that any accidental leakage may be detected and corrected before extensive contamination occurs. Finally, it is a further object of this invention to provide for the installation of an underground storage tank without the necessity of having a workman stand or walk in an unsupported excavation.

In accordance with the teachings of the present invention, there is disclosed herein a preferred embodiment of an underground installation method and apparatus for storage tanks to be used primarily for gasoline storage at automobile service stations. The preferred method includes preparing a suitable excavation for containing the storage tank at a predetermined depth, pouring a concrete floor in the bottom of the excavation, lining the walls of the excavation with sheetrock, and spraying a fiberglass coating onto the walls and floor to form a fiberglass vault. The fiberglass vault constructed by the preferred method of this invention serves as an effective secondary fluid containment system for underground storage tanks, the tanks themselves being the primary containment system.

The preferred embodiment of this invention also includes placing structural support members in the walls of the resulting fiberglass vault. Preferably, the support members consist of V-shaped strips of cardboard, the open sides of which are stuck to the walls while the first coat of fiberglass is still wet and tacky. Then, one or more additional layers of fiberglass are sprayed onto the interior surface of the vault including the cardboard strips. Once dry, the fiberglass coating on the cardboard strips forms vertical ribs in the walls of the vault, thus significantly increasing the strength of the walls. Said structural support members minimize the chances of a cave-in, enabling workers to enter the vault without fear of being buried alive. Additionally, the unique features of this invention allow the fiberglass vault to be constructed, complete with structural support members, without any workers standing or walking in the excavation.

In accordance with the further teachings of the present invention, observation wells with conventional leak detectors are installed on both the interior and exterior of the fiberglass vault. The interior observation wells serve to immediately detect any leakage from the storage tank into the vault, while the exterior observation wells operate to detect any leakage through the vault into the surrounding earth.

These and other objects of the present invention will become apparent from a reading of the following specification, taken in conjunction with the enclosed drawings.

DESCRIPTION OF THE PREFERRED EMBODIMENT

Figure 1:
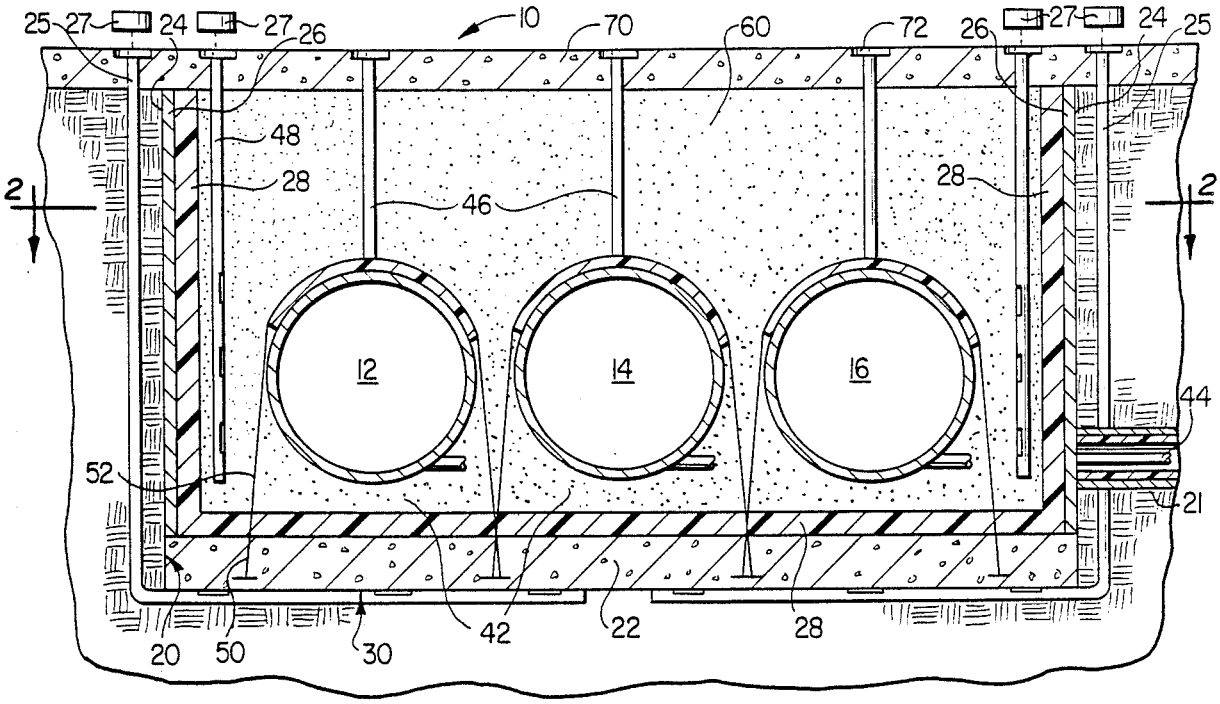
FIG. 1 a cross-sectional end view of an underground storage tank installation incorporating a specially designed vault structure embodying principles of the present invention.
Figure 2:
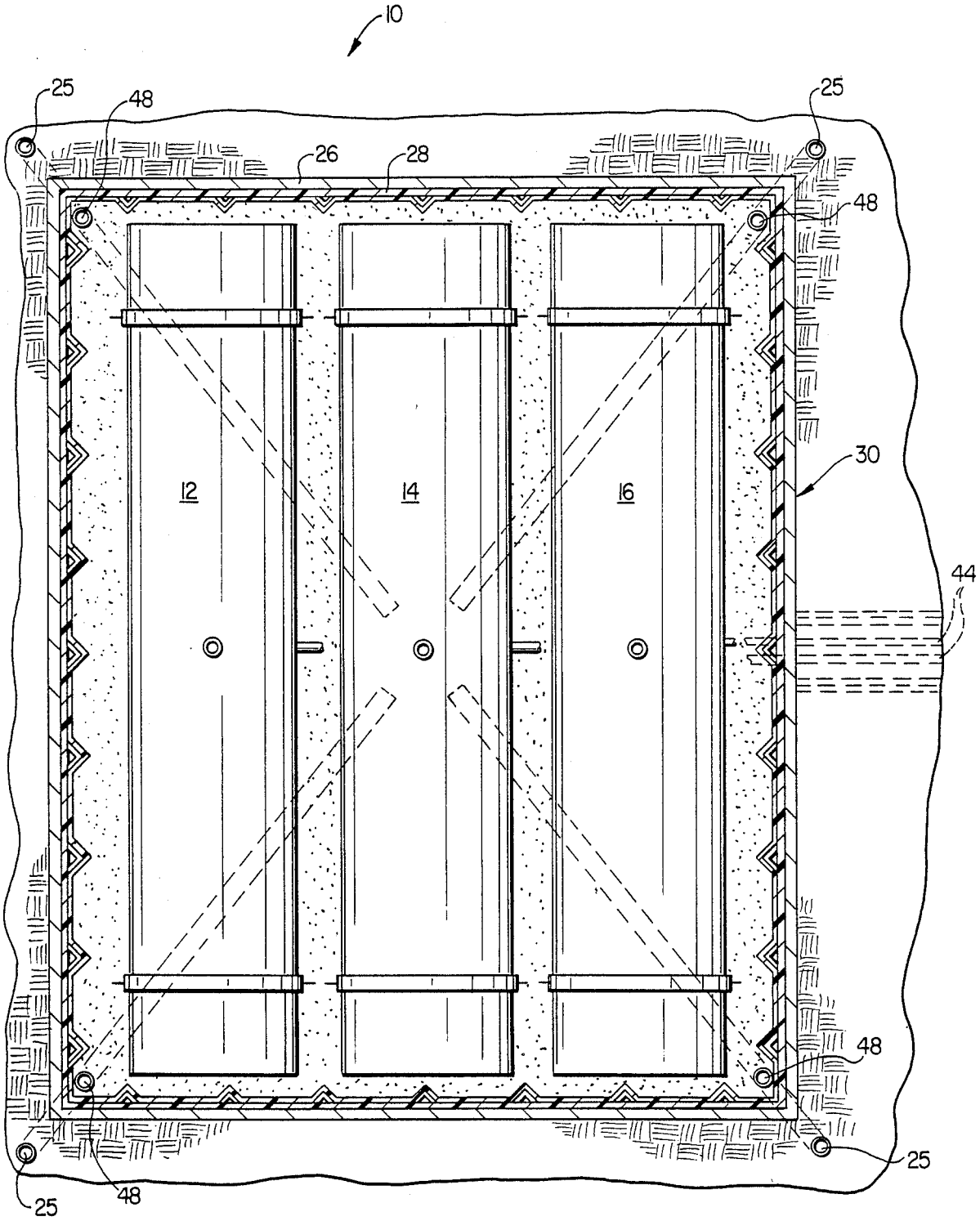
FIG. 2 is a top sectional view through the installation taken along the line 2—2 of FIG. 1.

Installation 10 of an underground storage tank facility embodying principles of the present invention is depicted in FIGS. 1 and 2. The preferred method of installing underground storage tanks 12, 14 and 16 is best explained by a step-by-step description, making reference to the components illustrated in FIGS. 1, 2, and 3. It is noted that, while the description of the preferred embodiment of this invention deals with the installation of three storage tanks, the method and apparatus disclosed herein may be employed for the installation of any greater or lesser number of such tanks. The preferred embodiment is designed to fulfill the needs of the typical installation, wherein three tanks are installed for an automobile service station selling three different grades of gasoline which must be separately contained.

To accomplish the installation 10 of FIG. 1, a pit 20 of suitable dimensions is excavated in a conventional manner. For a typical three-tank installation, with each tank being of conventional design and having a capacity of approximately 12,000 gallons, pit 20 is approximately 40 feet long, 32 feet wide, and 13 feet deep. Variations in these dimensions will not affect the scope of the invention disclosed herein. Also to be excavated is trough 21, which extends from a low point in pit 20 at a slight upward incline to the general vicinity of the gasoline pumps (not shown).

Once pit 20 has been suitably excavated, base 22 is installed. Preferably, base 22 consists of a concrete slab which is poured into the bottom of pit 20 and allowed to harden. Sides 24 of pit 20 are then lined with panels 26 of a moisture absorbent material such as conventional sheetrock. After all four walls 24 have been lined with sheetrock panels 26, a uniform fiberglass-resin coating 28 is sprayed onto panels 26 and base 22 in a manner which results in a unitary fiberglass vault 30. Panels 26 and base 22 effectively serve as a mold into which vault 30 is cast.

Sheetrock was selected as the material of choice for panels 26 because it is relatively inexpensive, readily available, and is suitably absorbent and rigid for the purpose. The liquid fiberglass-resin mixture adheres extremely well to sheetrock, and the absorbency of sheetrock reduces the curing time required for the fiberglass by quickly drawing away excess moisture. Finally, sheetrock is sufficiently rigid to support the weight of the fiberglass mixture until said mixture has cured.

Figure 3:
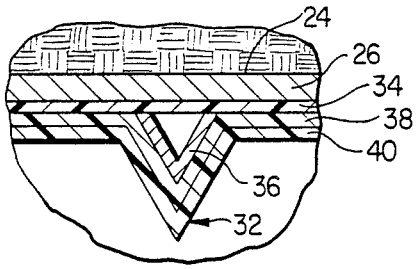
FIG. 3 is an enlarged sectional view of a support member used to reinforce the vertical walls of the vault.

As shown in FIGS. 2 and 3, the walls of the preferred embodiment of vault 30 include vertical structural support ribs 32. As best illustrated in FIG. 3, support ribs 32 are constructed by spraying a first layer 34 of the fiberglass-resin mixture onto sheetrock panels 26. While first layer 34 is still wet and tacky, the side edges of generally V-shaped cardboard strips 36 are pressed against and adhered to first layer 34. Due to the natural adhesive quality of curing fiberglass, cardboard strips 36 may be maintained vertically without the use of any additional fastening or securing devices. Cardboard strips 36 extend generally from the top of pit 20 to the upper surface of concrete base 22. Once the desired number of cardboard strips 36 have been placed in a spaced apart relationship to one another as shown in FIG. 2, a second layer 38 of fiberglass-resin mixture is applied to completely cover the first layer 34 and cardboard strips 36. Finally, a third fiberglass-resin layer 40 is applied so that the resulting fiberglass coating 28 consists of three consecutive layers 34, 38 and 40, with vertical support ribs 32 being defined by the protrusions caused by the presence of cardboard strips 36 between layers 34 and 38. In practice, Applicant has determined that such construction provides adequate strength for vault 30 with minimal use of fiberglass. Preferably, fiberglass coating 28 is approximately $\frac{1}{4}$ to $\frac{1}{2}$ inch thick, with support ribs 32 protruding therefrom approximately 2 inches. It is understood, however, that the number of fiberglass layers, the thickness of fiberglass coating 28, and the configuration of support ribs 32 may be altered as desired. Support ribs 32, for example, could easily be made with a circular cross section by substituting round wooden dowels or round cardboard tubes for cardboard strips 36.

Cardboard strips 36 were chosen as the foundation for support ribs 32 simply because cardboard is plentiful, inexpensive, and easy to work with. The sole purpose of cardboard strips 36 is to create relatively narrow ribs in the walls of vault 30 to strengthen the walls and thus minimize the likelihood of a cave-in. The additional strength, however, is a virtue of the hardened fiberglass covering strips 36, said cardboard strips becoming virtually insignificant once the additional fiberglass layers are applied and cured. Therefore, it is clear that any number of items would make perfectly suitable alternatives for cardboard strips 36.

The preferred method of applying the multiple layers of fiberglass is by spraying with conventional means. The preferred composition for the fiberglass is approximately 60% resin and 40% glass fibers, which is not a conventional mixture. A lower volumetric percentage of glass fibers is preferred for this invention because such a mixture imparts a degree of flexibility into vault 30 which is ordinarily undesirable for fiberglass structures. Such flexibility is highly desirable in this application so that vault 30 will bend slightly rather than crack as the surrounding earth expands and contracts.

It is intended that the fiberglass vault 30 can be installed, complete with support ribs 32, without any workers having to stand in an unsupported excavation. This is accomplished by lowering a single worker into pit 20 by means of a conventional hydraulic "bucket" apparatus as commonly used by electric power line repairmen. The sole worker operating from said bucket is able to place sheetrock panels 26 into position, apply first fiberglass layer 34, adhere cardboard strips 36 to first layer 34, and apply additional fiberglass layers 38 and 40 without setting foot in the bottom of pit 20. This feature of Applicant's invention significantly reduce the likelihood of injury to the workers installing underground storage tanks.

After vault 30 has fully cured (approximately 4–6 hours), a suitable base layer 42 of pea gravel is poured onto the floor of vault 30, and tanks 12, 14, and 16 are placed directly on said base layer 42. Tanks 12, 14, and 16 may then be connected to conventional supply lines 44 and 46, and secured within vault 30 by means of conventional anchors 50 and cables 52. It will be readily apparent to one skilled in the art of fiberglass construction that anchors 50 may be placed in concrete base 22 before said concrete has hardened, with fiberglass coating 28 encasing and adhering to anchors 50 so that anchors 50 protrude upwardly through the floor of vault 30 without creating any passageways for leakage. Alternatively, anchors 50 may be placed on or slightly above the floor of vault 30 and secured in place by the base layer 42 of pea gravel.

The preferred embodiment of this invention also includes internal observation wells 48 which may be located at each corner of vault 30 as shown in FIG. 2. Extending vertically from just above ground level to the floor of vault 30, observation wells 48 serve to provide for the detection of any accidental leakage within vault 30. It is contemplated that observation wells 48 include conventional leakage detectors 27 which will automatically alert the operator of the service station or other facility if an underground tank leaks. It is further contemplated that pumps may be utilized to withdraw, through observation wells 48, any leakage which may be contained within vault 30.

As an additional measure of leak detection capability, external observation wells 25 may be included such that any leakage through vault 30 into the surrounding ground can be detected, wells 25 also being equipped with automatic leakage detectors 27 of conventional design. Preferably, external wells 25 extend vertically from just above ground level to just below the lower surface of base 22. Wells 25 may, however, also extend horizontally as shown in FIGS. 1 and 2 in an alternative embodiment described below.

Once tanks 12, 14, and 16 have been suitably anchored and connected to supply lines 44 and 46, and observation wells 48 placed within the interior of vault 30, the remaining volume of vault 30 is completely filled with pea gravel 60. The final step in the preferred installation method is to seal the top of vault 30 with slab 70 as shown in FIG. 1. Typically, slab 70 consists of the concrete or asphalt ground-covering surface of the service station. Suitable cover plates are also installed to provide access to observation wells 25 and 48 and supply lines 46.

Figure 4:
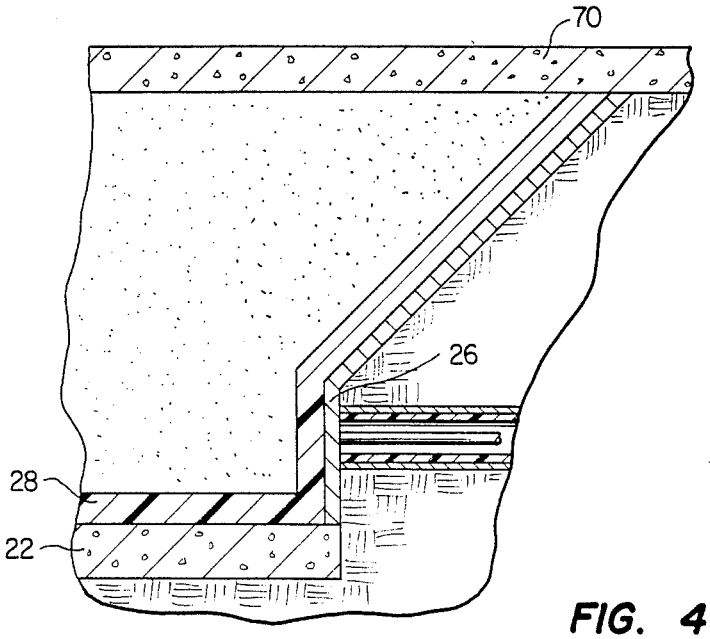
FIG. 4 is a sectional end view showing an alternative vault embodiment having outwardly sloped sidewalls.

The invention disclosed herein lends itself to a variety of alternative embodiments, one of which is depicted in FIG. 4. In order to comply with many local city ordinances governing excavations, the sides of pit 20 may be sloped outwardly as shown. Accordingly, the walls of fiberglass vault 30 will also slope outwardly, with no significant change in the method described above being required. Since sloped walls minimize the risk of cave-ins, it is contemplated that this alternative embodiment need not include vertical support ribs 32. Of course said support ribs 32 may be included as an added safety measure if desired.

Another intended variation in the present invention lies in the construction of trough 21 which serves as a conduit for supply lines 44. As shown in FIG. 1, trough 21 may be lined with sheetrock and fiberglass if so desired. Such construction of trough 21 will ensure that any leakage escaping from supply lines 44 will either be contained within trough 21 or will flow down trough 21 into vault 30 and be contained therein.

It is also anticipated that, under certain circumstances, a concrete base will not be required for the installation described herein. In such cases base 22 may comprise sheetrock panels disposed in the bottom of pit 20 to serve as the form for fiberglass coating 28. When sheetrock is substituted for concrete in base 22, external wells 25 preferably extend diagonally beneath said sheetrock, as indicated in FIGS. 1 and 2. Such installation of external wells 25 may be accomplished by placing said wells inside pit 20 prior to installing sheetrock base 22. Next, a sufficient amount of backfill is placed around the lower, horizontal sections of wells 25, so that a generally level surface is prepared upon which sheetrock base 22 is positioned. Finally, sheetrock panels 26 are lowered into place and fiberglass coating 28 is applied as described above.

Accordingly, the present invention provides a commercially practical underground installation method for storage tanks. Any leaks developing in the storage tanks are easily detectable and, more importantly, are contained within the specially designed fiberglass vault to eliminate contamination of the surrounding ground and water supplies. This invention offers significant advantages over the prior art in that the storage tanks may be installed within 24 hours of constructing the vault, whereas concrete vaults for the same purpose require several days to cure. Furthermore, the installation accomplished by this invention is significantly less expensive than that accomplished by most conventional methods and is also more effective in containing accidental leaks.

Obviously, many modifications may be made without departing from basic spirit of the present invention. Accordingly, within the scope of the appended claims the invention may be practiced other than specifically disclosed herein.

What is claimed is:

1. A method of installing an underground storage tank comprising:

excavating a pit having a predetermined depth sufficient for the placement of a storage tank of desired size therein below ground level, said pit having side surfaces and a lower surface;

installing a base covering said lower surface of said pit;

lining the side surfaces of said pit with moisture absorbent generally rigid wall sections;

depositing at least one substantially uniform layer of a mixture of liquid resin and glass fibers onto the interior surfaces of said wall sections and said base allowing said wall sections to absorb excess moisture from said mixture thereby promoting rapid hardening of said resin, whereby a fiberglass vault is defined by said layer of resin and glass fibers upon hardening of said resin;

securing said underground storage tank to the floor of said fiberglass vault;

installing piping between said underground storage tank and ground level;

backfilling said fiberglass vault with covering material over said tank and piping to a height adjacent ground level; and forming a solid slab over said covering material.

2. The method according to claim 1 wherein:

the step of lining side surfaces of said pit is performed by placing conventional sheetrock panels adjacent said side surfaces.

3. The method according to claim 1 wherein:

the step of installing a base is performed by pouring a concrete slab onto the lower surface of said pit.

4. The method according to claim 1 wherein:

the step of installing a base is performed by positioning conventional sheetrock panels adjacent the lower surface of said pit.

5. The method according to claim 1 wherein:

the step of excavating a pit is performed by digging a generally rectangular hole having four vertical side surfaces and a horizontal lower surface.

6. The method according to claim 1 further comprising the step of:

installing a plurality of vertical structural support members in the walls of said fiberglass vault, said support members being encased between adjacent layers of said mixture of resin and glass fibers.

7. The method according to claim 1 further comprising the step of:

backfilling said fiberglass vault with a layer of covering material prior to lowering said storage tank into said fiberglass vault, whereby said layer of covering material is disposed between said storage tank and the floor of said fiberglass vault.

8. The method according to claim 1 wherein:

the step of securing said underground storage tank is performed by placing cables circumferentially over said tank and attaching the opposite ends of said cables to anchors protruding upwardly from said floor of said fiberglass vault.

9. The method according to claim 1 wherein:

the step of backfilling said fiberglass vault with covering material is performed by filling said vault with pea gravel.

10. The method according to claim 1 wherein:

the step of depositing at least one substantially uniform layer of a mixture of liquid resin and glass fibers is performed by spraying a mixture comprising 60% resin and 40% glass fibers, by volume, onto the interior surfaces of said wall sections and said base.

11. The method according to claim 1 further comprising the step of:

installing at least one observation well outside said fiberglass vault, said observation well extending vertically from ground level to the lower surface of said pit such that, in the event of leakage of the contents of said storage tank through the floor of said fiberglass vault, said leakage is detectable from ground level through said observation well.

12. The method according to claim 1 further comprising the step of:

installing at last one observation well within said fiberglass vault, said observation well extending vertically from ground level to the floor of said fiberglass vault such that, in the event of leakage of the contents of said storage tank, said leakage is detectable from ground level and may be withdrawn from said fiberglass vault through said observation well.

13. The method according to claim 1 wherein:

the step of excavating a pit is performed by digging a hole having side surfaces and a lower surface, wherein said side surfaces include lower and upper portions, said lower portions being generally vertical and said upper portions being angled outwardly away from the center of said pit.

14. A vault for containing one or more underground storage tanks comprising:

a floor, comprising at least one hardened layer of a mixture of resin and glass fibers; and generally vertical walls contiguous with said floor and extending upwardly therefrom in a manner that defines separate interior and exterior surface for said vault, said walls comprising at least one hardened layer of a mixture of resin and glass fibers, said exterior surface including means being operative to absorb excess moisture from said mixture thereby promoting rapid hardening of said resin.

15. The apparatus according to claim 14 wherein:

said floor includes anchor means for securing said storage tanks thereto.

16. The apparatus according to claim 14 wherein:

said walls include vertical support ribs formed therein, said support ribs comprising support members embedded between consecutive layers of said mixture of resin and glass fibers.

17. The apparatus according to claim 16 wherein:

said support structures comprise generally V-shaped strips of cardboard.

18. The apparatus according to claim 14 wherein:

said mixture of resin and glass fibers comprises approximately 60% resin and 40% glass fibers by volume.

19. The apparatus according to claim 14 further comprising:

at least one internal observation well extending from ground level vertically inside said vault, whereby any leakage of the contents of said storage tank into said vault is detectable from ground level.

20. The apparatus according to claim 19 wherein:

said observation well includes an automatic leak detector.

21. The apparatus according to claim 14 further comprising:

at least one external observation well extending from ground level vertically outside said vault, whereby any leakage of the contents of said tank through said vault into the surrounding earth is detectable from ground level.

22. The apparatus according to claim 21 wherein:

said observation well includes an automatic leak detector.

23. A secondary containment apparatus for containing leakage from an underground liquid storage tank, said apparatus comprising:

a generally rectangular shaped box having a base member and side members extending upwardly therefrom, said side members comprising generally rigid, moisture absorbent panels;

a mixture of liquid resin and glass fibers deposited onto the interior of said box so that a substantially uniform coating of said mixture adheres to said base member and said side members, said moisture absorbent panels being operative to absorb moisture from said mixture thereby promoting rapid hardening of said resin; whereby a fiberglass vault is defined by said coating of said mixture of resin and glass fibers upon curing thereof.

24. The apparatus according to claim 23 wherein the walls of said fiberglass vault include vertical support ribs formed therein, said support ribs comprising support members embedded between consecutive layers of said mixture of resin and glass fibers.

25. The apparatus according to claim 23 further comprising at least one internal observation well disposed within said fiberglass vault such that any leakage contained therein is detectable from ground level.

26. The apparatus according to claim 25 further comprising an automatic leak detector disposed within side internal observation well.

27. The apparatus according to claim 23 further comprising at least one external observation well disposed outside said fiberglass vault such that any leakage through said fiberglass vault is detectable from above ground.

28. The apparatus according to claim 27 further comprising an automatic leak detector disposed within said external observation well.

29. The apparatus according to claim 23 wherein said base member comprises a concrete slab.

30. The apparatus according to claim 23 wherein said side members comprise sheetrock panels.

31. The apparatus according to claim 23 wherein said base comprises sheetrock.

32. The apparatus according to claim 23 wherein said side members are generally vertically disposed.

33. The apparatus according to claim 23 wherein said side members comprise upper and lower sections, said lower sections being generally vertical and said upper sections being sloped outwardly away from the center of said box.

* * * * *